US007692600B1

(12) United States Patent
Pakosz et al.

(10) Patent No.: US 7,692,600 B1
(45) Date of Patent: Apr. 6, 2010

(54) INTERNAL UTILITY METER ANTENNA

(75) Inventors: Daniel Pakosz, Elgin, IL (US); Clifford Raiman, Roselle, IL (US)

(73) Assignee: Mobile Mark, Inc., Schiller Park, IL (US)

( * ) Notice: Subject to any disclaimer, the term of this patent is extended or adjusted under 35 U.S.C. 154(b) by 0 days.

(21) Appl. No.: 12/475,868

(22) Filed: Jun. 1, 2009

Related U.S. Application Data

(60) Provisional application No. 61/197,069, filed on Oct. 22, 2008.

(51) Int. Cl.
*H01Q 9/28* (2006.01)

(52) U.S. Cl. ..... 343/795; 343/821

(58) Field of Classification Search ..... None
See application file for complete search history.

(56) References Cited

U.S. PATENT DOCUMENTS

2006/0238426 A1* 10/2006 Savage et al. ..... 343/702
2007/0085750 A1* 4/2007 De Angelis ..... 343/702
2008/0062055 A1* 3/2008 Cunningham ..... 343/767
2008/0129536 A1 6/2008 Randell et al.

* cited by examiner

*Primary Examiner*—HoangAnh T Le
(74) *Attorney, Agent, or Firm*—George H. Gerstman; Seyfarth Shaw LLP

(57) ABSTRACT

A utility meter has an internal antenna for transmitting data. The antenna is positioned between the radome of the utility meter and its front surface. The antenna comprises dipole radiator that is generally curved to the shape of the meter housing. The dipole radiator comprises a dielectric substrate carrying two asymmetric curved radiating metallic sheets, each forming a portion of the dipole, which combined extend about 135° of the circumference of the utility meter. A balun feed is connected to the metallic sheets and a transmission line is coupled to a transmitter.

17 Claims, 7 Drawing Sheets

INTERNAL UTILITY METER ANTENNA

This application claims the benefit of priority to Provisional Application Ser. No. 61/197,069 filed Oct. 22, 2008 and incorporates herein the disclosure of the Provisional Application.

I. FIELD OF THE INVENTION

The present invention is in the field of remote utility meter monitoring. More particularly, the present invention is in the field of internal antenna design for utility meters to optimize electrical performance.

II. BACKGROUND OF THE INVENTION

Certain prior art utility meters, including residential and commercial utility meters, are fixed and rely on manual recording of services used. Other prior art utility meters use internal electronic components which read the data remotely, thus eliminating the need for an individual to manually go to each utility meter and manually record the data. In this type of prior art device, the data is transmitted via radio using an external antenna that is typically outside of the utility meter housing, for remote monitoring.

To increase mechanical reliability, in a prior art system the antenna is relocated internally, severely impacting the electrical performance. The result has been loss of signal resulting in communication loss, incomplete data, and reduced performance.

The location and type of antenna used is important criteria in determining whether the utility meter will have poor or good electrical performance for transmitting and receiving the data signal. I have discovered an internal utility meter antenna that optimizes the electrical performance of the meter for transmitting and receiving the data signal, thus improving the data communication.

III. SUMMARY OF THE INVENTION

In the present invention, a one or two part dipole radiator for single band or multi-band application is provided and is located internally in the utility meter. The dipole radiator is unique in its location and shape within the utility meter, with the location and shape allowing for optimal electrical performance compared to prior art internal antennas that have been used.

In accordance with the present invention, a utility meter is provided having an antenna for transmitting data. In an illustrative embodiment, the utility meter comprises a meter housing comprising a generally circular sidewall and a front surface displaying a meter readout. A radome encloses the front surface and the antenna is positioned intermediate the radome and the front surface. The antenna comprises a dipole radiator that is generally curved to the shape of the meter housing. The dipole radiator comprises a dielectric substrate carrying two asymmetric curved radiating metallic sheets. Each of the metallic sheets forms a portion of the dipole, which combined extend between 90° and 180° of the circumference of the utility meter. A balun feed is connected to the metallic sheets and a transmission line is provided for coupling to a transmitter.

In an illustrative embodiment, the antenna is connected to the front surface of the meter housing. The metallic sheets comprise a pair of radiating elements, forming a dual band antenna. One of the radiating elements has a path that is longer than the other, with the longer path serving to generate the lower frequency operating mode of the dual band antenna. In the preferred embodiment of the invention, the metallic sheets combined extend about 135° of the circumference of the utility meter. The metallic sheets extend within the upper right portion of the front surface of the utility meter.

In an illustrative embodiment, the transmission line is a coaxial cable. The meter housing has a notch defined within its sidewall, and the balun is positioned within the notch.

In an illustrative embodiment, the radiator has a first high frequency path and a second low frequency path spaced from the high frequency path, with the second path being longer than the first path. Each of the metallic sheets is spaced from but is capacitively coupled to the other. The balun is coupled to the area adjacent the capacitive coupling of one of the metallic sheets to the other.

A more detailed explanation of the invention is provided in the following description and claims, and is illustrated in the accompanying drawings.

IV. BRIEF DESCRIPTION OF THE DRAWINGS

Figure 6:
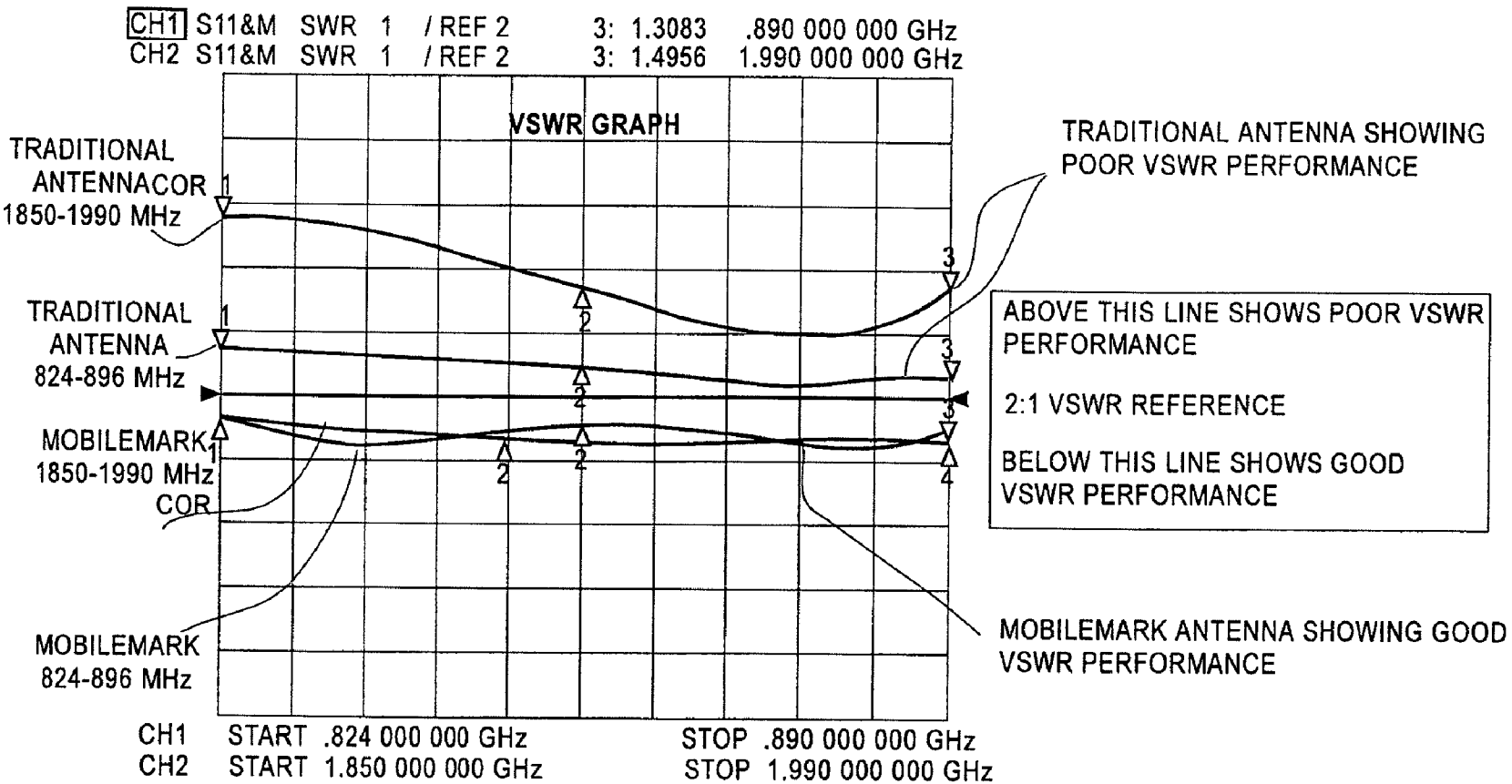
Figure 7:
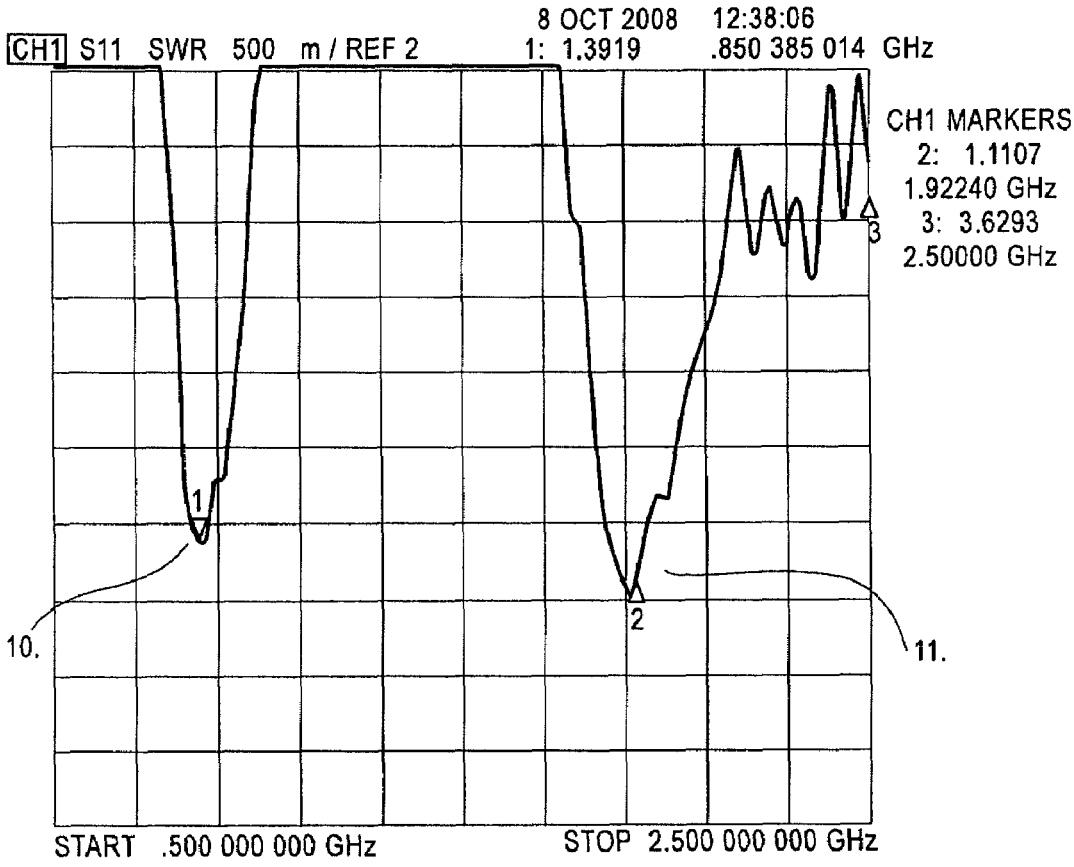

FIGS. 4*a*-4*d* are dimension drawings of an illustrative embodiment of the present invention;

FIGS. 5*a*-5*d* are elevations and azimuth plots at 850 MHz and 1850 MHz comparing the present invention with a prior art utility meter antenna;

FIGS. 6 and 7 are VSWR graphs of the present invention.

V. DETAILED DESCRIPTION OF THE ILLUSTRATIVE EMBODIMENT

Figure 1:
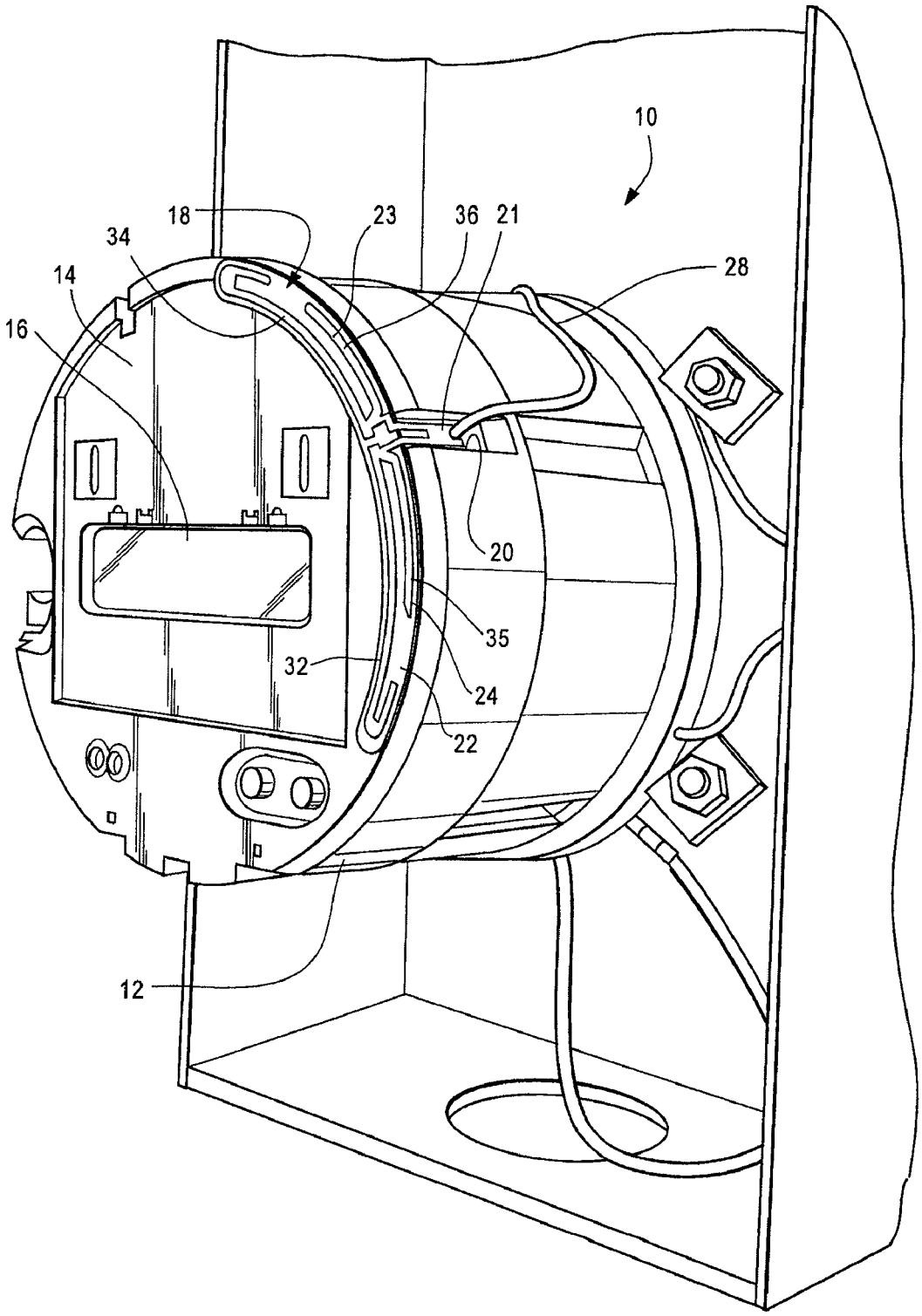
FIG. 1 is a perspective view of a utility meter having an antenna constructed in accordance with the principles of the present invention.

Referring to FIG. 1, a utility meter 10 is shown therein having a generally circular sidewall 12 and a front surface 14 which presents a readout 16. A transparent glass or plastic radome (not shown) covers the front surface 14 as is conventional with utility meters. The radome (protective meter cover) may be made of a dielectric material such as polycarbonate, glass, lexan, or similar dielectric materials.

A typical meter housing used for residential and commercial use has a diameter between 4 inches and 7 inches. A dual band dipole antenna 18 is fastened to the top surface 14 of the utility meter 10. A notch 20 is defined by the sidewall 12, with the balun portion 21 of the antenna positioned within the notch 20.

I have found that the antenna radiator gives best performance when it is generally curved or contoured to the shape of the meter housing.

Figure 2:
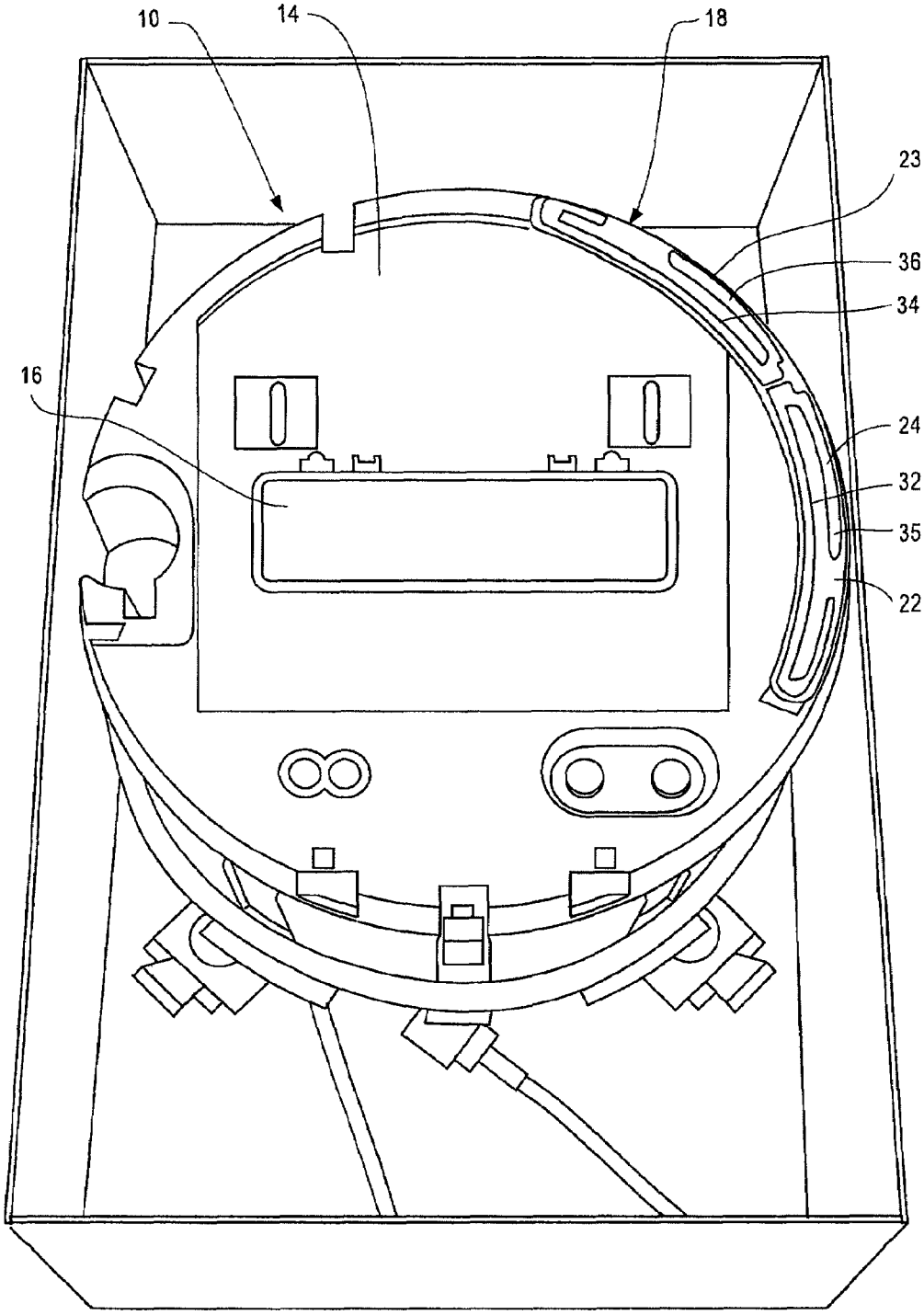
FIG. 2 is a front view thereof.
Figure 3:
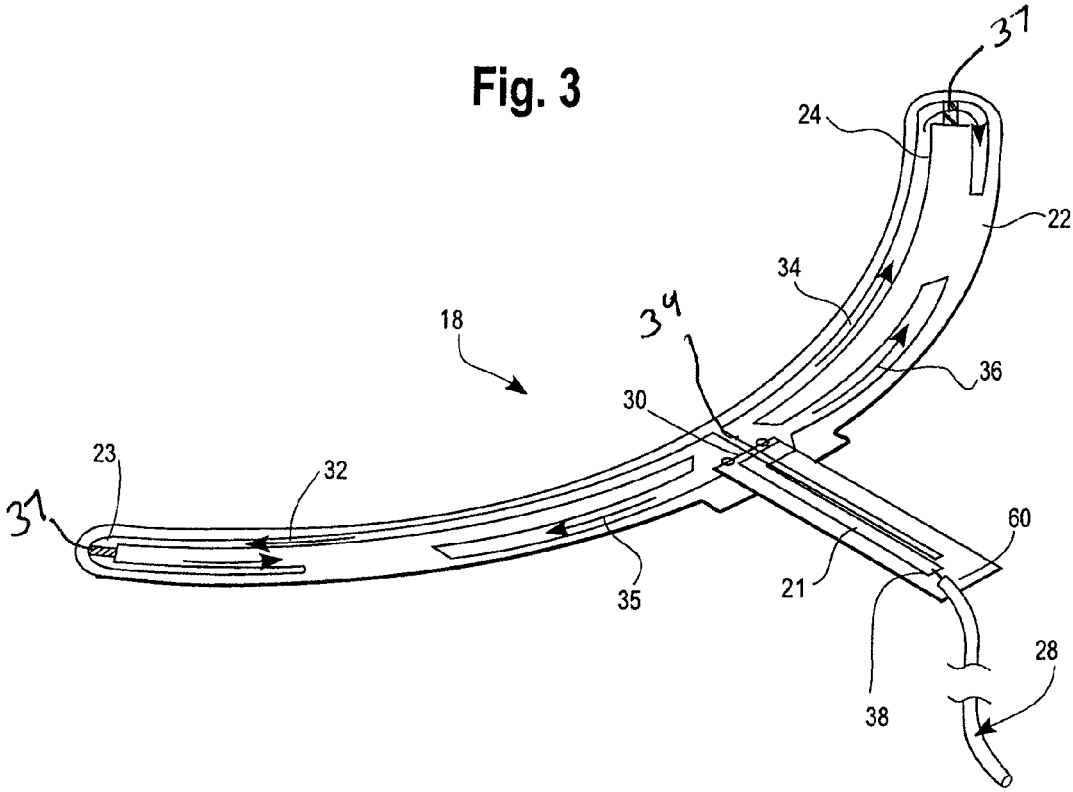
FIG. 3 is a diagrammatic view of an antenna constructed in accordance with the principles of the present invention.

Referring to FIGS. 1-3, the dipole antenna 18 includes a dielectric substrate 22 and it comprises two asymmetrically curved radiating metallic sheets 23 and 24, a balun feed 21, and a coaxial transmission line 28. The two distinctly shaped curved radiating metallic sheets 23, 24 are asymmetrically placed on one side of the dielectric substrate with respect to the mid point thereof. Each of the radiating metallic sheets is electrically connected to each side of the balun 21 and has a feeding point 30, at the lower location. The distinctly shaped radiating metallic sheets are asymmetric in length, thus creating multiple paths. The longer path 32, 34 serves to generate the lower frequency operating mode of the dual band dipole antenna. Capacitive coupling 37 is provided to drive the low frequency band of operation. Spacing 39 adds capacitance for matching. The short path 35, 36 serves to generate the higher frequency operating mode of the dual band dipole antenna.

The coaxial transmission line 28 has a center conductor 38 which is connected to the balun's lower feed point. The signal emanating from the feed point coaxial travels via the balun 21 and continues to each path of the asymmetrical legs of the radiator dipole, thus resulting in a dual band resonance.

The substrate can be modified in length and width to achieve other frequencies of interest, for example, 2.4 and 5 GHz. Although no limitation is intended, the preferred band of the present invention is 0.824 GHz through 0.890 GHz and 1.85 GHz to 1.990 GHz. Experiments have found that the present invention results in a dual band radiator with a voltage standing wave ratio (VSWR) of less than 2 in the meter housing.

Still referring to FIG. 3, as stated above the multi-band dipole antenna includes two asymmetrically curved metallic radiating sheets 23, 24 and a coaxial transmission line 28. The asymmetric metallic radiating sheets have a corresponding attachment point 30 and are curved in shape to generally match the curve of the meter housing. The metallic radiating sheets are asymmetrically positioned on two opposite sides of the dielectric substrate 22, thus forming the two legs of the antenna and are secured thereon by means of etching, printing, or other fabricating technique.

In accordance with the present invention, the dielectric substrate 22 is in a form of a printed circuit board made of Arlon, FR4, Taconic, Rogers or comparable material such as flexible film substrate made of polyimide or like substrates. The feed points are disposed on the metallic sheets at the base of the balun, which carries the transmitting signals to the asymmetric curved metallic sheets. The shorter paths 35 and 36 of the asymmetric lengths serve to generate a first higher frequency operating mode of the antenna 10, and the longer asymmetric paths 32 and 34 serve to generate a second lower frequency operating mode of the antenna 1. The length of each path is approximately one quarter wavelength.

The first (high frequency) path has a mid operating mode around 1.920 GHz extending out either side of the band 1.850 GHz and 1.990 GHz respectively. The bandwidth of the "lower frequency" path's mid operating mode is approximately 0.850 GHz extending out either side of the band 0.824 GHz and 0.890 GHz, with a VSWR typically less then 2. In addition to path, the asymmetric metallic radiating elements add additional coupling that improves the VSWR and frequency pattern performance.

For best VSWR and radiation pattern performance, it has been found that the asymmetric curved metallic radiating sheets 23 and 24 that are spaced between the radome cover and the meter housing are placed at the upper right portion between 0 and 135° shown in FIG. 1. Referring to FIG. 3, in order to obtain a dual band operation of different mid operating modes, the paths can be modified in length and shape whereby a dual band radiator antenna adapted to the 2.4 and 5 GHz and other wireless local area network (WLAN) operation is designed. The resonant frequencies of the dual band asymmetric radiator can have good impedance matching without the need for interfacing with any additional matching circuits.

Figure 4A:
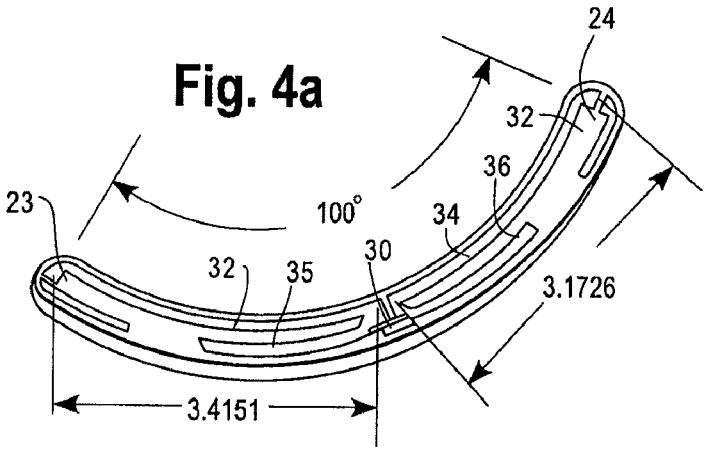

FIG. 4*a* illustrates typical angle or curvature of the dual-band dipole, and the approximate length of the lower frequency dual-band dipole arm.

Figure 4B:
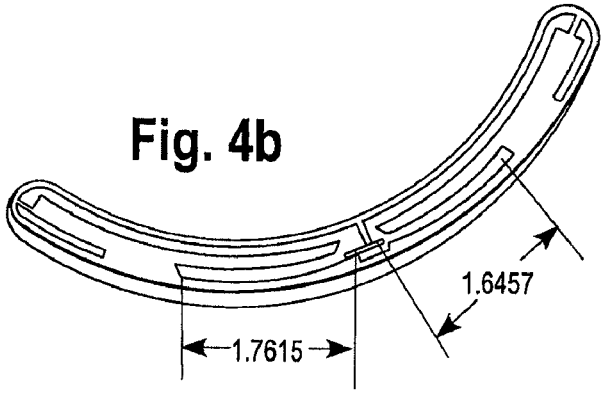

FIG. 4*b* illustrates the approximate length of the higher frequency dual-band dipole arm.

Figure 4C:
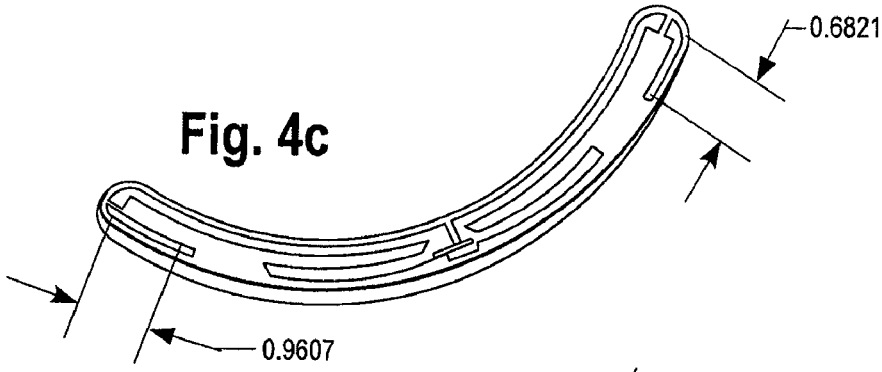

FIG. 4*c* illustrates the approximate length of the lower frequency dual-band parasitic dipole arm.

Figure 4D:
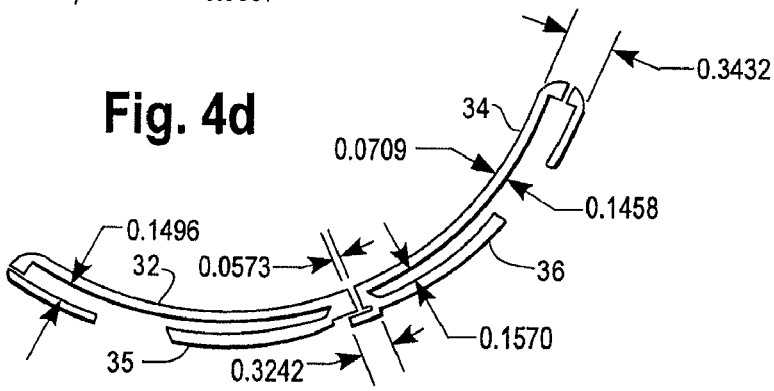
Figure 5A:
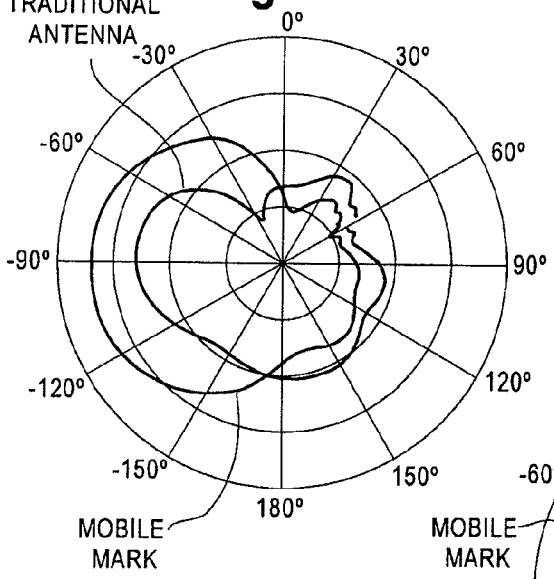
Figure 5B:
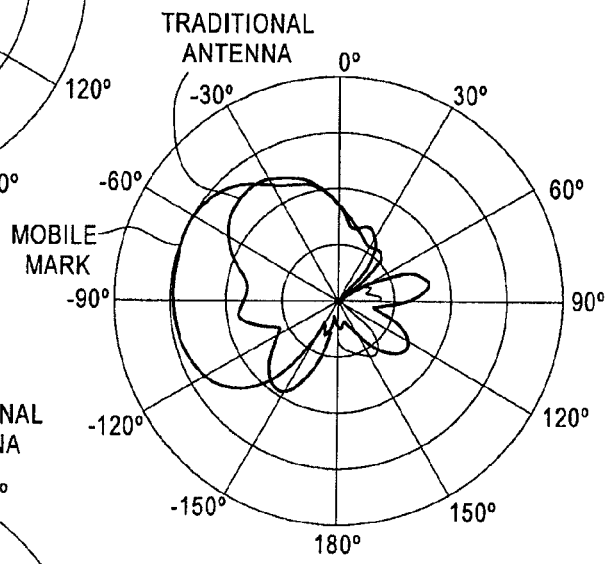
Figure 5C:
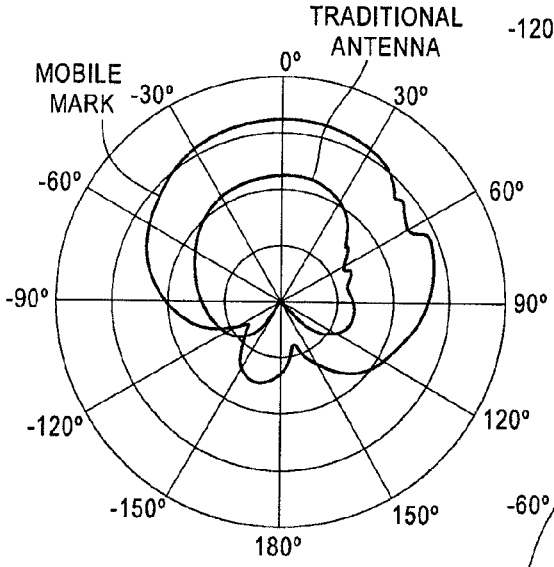
Figure 5D:
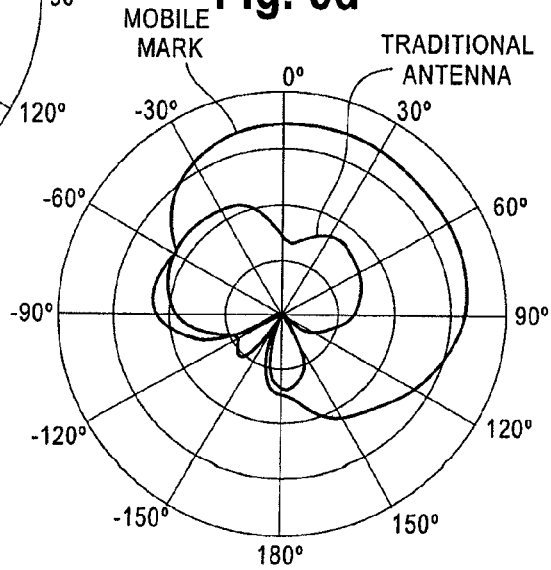

FIG. 4*d* shows approximate dimensions of the dual-band dipole radiating element. It is approximately ¼ wavelength in each arm length for the mid frequencies of both band. This invention also shows the approximate related dimensions in respect to the metallic sheeting bonded to the substrate. In FIGS. 4*a*-4*d*, a dual-band dipole is centered for 850 MHz and for 1920 MHz frequency bands. It should be understood that the dimensions can be scaled or resized for other frequency bands of interest.

Referring to FIGS. 5A-5D, the elevation and azimuth plots show therein indicate the improvement in characteristics of the radiation pattern performance of an embodiment of the present invention (labeled "MOBILE MARK") over a prior art antenna, both of which are used within a meter housing.

The VSWR graph of FIG. 6 shows the improvement of an embodiment of the antenna of the present invention (labeled "MOBILEMARK") located in the utility meter as compared to a prior art antenna located in a utility meter. FIG. 7 shows the VSWR of an embodiment of the antenna of the present invention.

An illustrative embodiment of the invention has been shown and described. It is to be understood that the various modifications and substitutions may be made without departing from the spirit and scope of the present invention.

That which is claimed:

1. A utility meter having an antenna for transmitting data, which comprises:

a meter housing comprising a generally circular sidewall and a front surface displaying a meter readout;

a radome enclosing the front surface;

the antenna being positioned intermediate the radome and the front surface;

the antenna comprising a dipole radiator that is generally curved to the shape of the meter housing;

the dipole radiator comprising a dielectric substrate carrying two asymmetric curved radiating metallic sheets, each forming a portion of the dipole, which combined extend between 90° and 180° of the circumference of the utility meter;

a balun feed connected to the metallic sheets; and a transmission line for coupling to a transmitter.

2. The utility meter of claim 1, in which the antenna is connected to the front surface of the meter housing.

3. The utility meter of claim 1, in which the metallic sheets comprise a pair of radiating elements, forming a dual band antenna.

4. The utility meter of claim 3 in which one of the radiating elements has a path that is longer than the other, with the longer path serving to generate the lower frequency operating mode of the dual band antenna.

5. The utility meter of claim 1, in which the metallic sheets combined extend between 120° and 150° of the circumference of the utility meter.

6. The utility meter of claim 1, in which the metallic sheets combined extend about 135° of the circumference of the utility meter.

7. The utility meter of claim 1, in which the metallic sheets extend at least within the upper right 90° portion of the front surface of the utility meter.

8. The utility meter of claim 7, in which the metallic sheets combined extend about 135° of the circumference of the utility meter.

9. The utility meter of claim 1, in which the transmission line is a coaxial cable.

10. The utility meter of claim 1, in which the meter housing has a notch defined within its sidewall, and the balun is positioned within the notch.

11. The utility meter of claim 1 in which the radiator has a first high frequency path and a second low frequency path spaced from the high frequency path, with the second path being longer than the first path.

12. The utility meter of claim 1, in which each of the metallic sheets is spaced from but capacitively coupled to the other.

13. The utility meter of claim 12, in which the balun is coupled to the area adjacent the capacitive coupling of one of the metallic sheets to the other.

14. The utility meter of claim 1, in which the dielectric is a printed circuit board with the metallic sheets being formed of copper and applied thereon.

15. A utility meter having an antenna for transmitting data, which comprises:

a meter housing comprising a generally circular sidewall and a front surface displaying a meter readout;

the antenna being connected to the front surface;

the antenna comprising a dipole radiator that is generally curved to the shape of the meter housing;

the dipole radiator comprising a dielectric substrate carrying two asymmetric curved radiating metallic sheets, each forming a portion of the dipole, which combined extend between 120° and 150° of the circumference of the utility meter;

the metallic sheets comprising a pair of radiating elements, forming a dual band antenna;

one of the radiating elements having a path that is longer than the other, with the longer path serving to generate the lower frequency operating mode of the dual band antenna;

a balun feed connected to the metallic sheets; and a transmission line for coupling to a transmitter.

16. The utility meter of claim 15, in which the housing has a notch defined within its sidewall and the balun is positioned within the notch.

17. The utility meter of claim 15, in which each of the metallic sheets is spaced from but capacitively coupled to the other, and the balun is coupled to the area adjacent the capacitive coupling of one of the metallic sheets to the other.

* * * * *